US006439301B1

(12) United States Patent
Maytal

(10) Patent No.: US 6,439,301 B1
(45) Date of Patent: Aug. 27, 2002

(54) HEAT EXCHANGERS

(75) Inventor: Ben-Zion Maytal, Atlit (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 08/846,884

(22) Filed: May 1, 1997

(30) Foreign Application Priority Data

May 6, 1996 (IL) ..... 118159

(51) Int. Cl.[7] ..... F28F 13/18

(52) U.S. Cl. ..... 165/184; 165/133; 29/890.048

(58) Field of Search ..... 165/184, 183, 165/133, 905, 104.13, 182, 179; 29/890.046, 890.048, 890.049

(56) References Cited

U.S. PATENT DOCUMENTS

| | | | | | |
|---|---|---|---|---|---|
| 1,578,254 | A | * | 3/1926 | Bennett | 165/133 |
| 3,011,466 | A | * | 12/1961 | Simpelaar | 165/182 |
| 3,406,753 | A | * | 10/1968 | Habdas | 165/104.13 |
| 3,999,363 | A | | 12/1976 | Gross | |
| 4,093,755 | A | * | 6/1978 | Dahl et al. | 165/133 |
| 4,102,027 | A | * | 7/1978 | Greever et al. | 165/182 |
| 4,126,017 | A | | 11/1978 | Bytniewski et al. | |
| 4,232,735 | A | * | 11/1980 | Kim et al. | 165/184 |
| 4,352,227 | A | * | 10/1982 | Ogata et al. | 165/184 |
| 4,514,900 | A | * | 5/1985 | Benard | 165/184 |
| 4,545,428 | A | * | 10/1985 | Onishi et al. | 165/184 |
| 4,915,166 | A | * | 4/1990 | Cunningham et al. | 165/184 |
| 4,957,388 | A | | 9/1990 | Liu | |
| 4,960,170 | A | * | 10/1990 | Carter | 165/184 |
| 5,022,442 | A | | 6/1991 | Bird | |
| 5,031,694 | A | * | 7/1991 | Lloyd | 165/184 |
| 5,240,070 | A | * | 8/1993 | Ryan | 165/184 |
| 5,241,840 | A | * | 9/1993 | Kennedy | 165/184 |
| 5,282,313 | A | | 2/1994 | Podhorsky et al. | |
| 5,333,682 | A | * | 8/1994 | Lui et al. | 165/184 |
| 5,339,654 | A | * | 8/1994 | Cook et al. | 165/184 |
| 5,366,004 | A | * | 11/1994 | Garner et al. | 165/133 |

FOREIGN PATENT DOCUMENTS

| | | | | |
|---|---|---|---|---|
| BR | 757352 | * | 6/1956 | 165/184 |
| FR | 1.298.197 | * | 5/1962 | 165/184 |
| GB | 779769 | * | 7/1957 | 165/184 |
| GB | 799391 | * | 8/1958 | 165/184 |
| GB | 2 085 785 | | 5/1982 | |
| GR | 308046 | * | 7/1917 | 165/184 |
| JP | 59-10951 | * | 1/1977 | 165/184 |

* cited by examiner

*Primary Examiner*—Henry Bennett
*Assistant Examiner*—Terrell McKinnon
(74) *Attorney, Agent, or Firm*—Merchant & Gould P.C.

(57) ABSTRACT

The invention relates to a heat exchanger, which includes a pipe, heat conductive fins having an elongate cross-section, and a coating of silver applied to the outer surface of the fins and the outer surface of the pipe adjacent to the fins. The fins of the heat exchanger, are a metal wire helically wound around the pipe, are connected to the pipe solely by the coating of silver.

18 Claims, 3 Drawing Sheets

HEAT EXCHANGERS

FIELD OF THE INVENTION

The invention relates to improved heat exchangers, providing increased heat exchange and faster operation, and particularly to exchangers used in cooling/heating devices of the Joule-Thompson type.

BACKGROUND OF THE INVENTION

Fast-changing heating/cooling devices which operate on the basis of the Joule-Thompson cycle, are known in the art. A method and apparatus of refrigeration of this kind is described, for instance, in U.S. Pat. No. 4,126,017. A device of this kind particularly for cryogenic and/or surgical use, is described in co-pending Israeli Patent Application No. 104506. While this invention is not limited to any particular type of heat exchanger and it should be understood that it has a general applicability, it is particularly useful for any heat exchangers used in apparatus of the Joule-Thompson type.

Such heat exchangers comprise a first duct which is at a high pressure and a second duct which is at a low pressure, the two ducts being in heat-exchanging relationship to one another. If the apparatus is a cooling device or a refrigerator, the working refrigerant fluid flows through the high pressure duct and the expanded refrigerant fluid flows through the low pressure duct. In a typical arrangement of such heat exchangers, the low pressure duct is an annular space between two tubular bodies and the high pressure duct is a pipe of small diameter, e.g. with an inner diameter comprised between 0.2 and 0.5 mm and a thickness comprised between 0.1 and 0.2 mm, helically disposed in said annular space and provided with fins. The expanded gas flows through said annular space and comes into contact with the outer surfaces of the fins, thus exchanging heat with the gas flowing within the high pressure pipe. The fins have a determining influence in providing good heat exchange.

In a type of heat exchanger of the prior art, the fins are provided by a copper wire having a rectangular cross-section—hereinafter designated as "ribbon"—which is wound helically about the high pressure pipe, with its longer side extending radially from the high pressure pipe and its shorter side being in contact with said pipe. The ribbon thus constitutes a continuous helical fin, immersed in the low pressure space. Each turn of the helical fin is equivalent to and may be considered as an individual annular fin, so that the helical fin is equivalent to a plurality of fins spaced from one another. Firmly to attach the ribbon, constituting said fin, to the outer surface of the high pressure pipe, a coating of tin is electrolytically applied to the copper ribbon and to the outer surface of the high pressure pipe, to bind them together.

While the performance of existing heat exchangers, so constructed, is not unsatisfactory, their performance is not as good as desirable, particularly as to the speed of the cool-down cycles.

It is therefore a first purpose of this invention to improve heat exchangers by improving their thermal performance.

It is another purpose of the invention to improve heat exchangers by rendering them capable of producing a quicker heat exchange, in the sense of a faster cool-down.

It is a further purpose of the invention to provide improved heat exchangers by improving their mechanical characteristics, in particular the connection high pressure pipes and the heat-conductive fins applied to their exterior.

It is a still further purpose of this invention to provide all such improvements in a very simple manner.

It is a still further of the invention to provide all the aforesaid improvements with particular reference to heat exchangers used in apparatus operating by the Joule-Thompson cycle.

Other purposes and advantages will appear as the description proceeds.

SUMMARY OF THE INVENTION

The improved heat exchanger according to the invention is characterized in that it comprises a pipe, in particular a high-pressure pipe, and heat-conductive fins, that are connected to the pipe by a coating of silver.

Preferably, the fins are constituted by a copper wire, more preferably, a rectangular cross-section, viz. a copper ribbin, helically wound about the pipe.

According to an aspect of the invention, the silver coating is produced electrolytically. Therefore, the invention provides a method for making a heat exchanger which comprises the steps of providing a pipe, providing a copper wire, preferably of a rectangular cross-section, viz. a copper ribbon, winding said wire helically about said pipe, and electronically applying a coating of silver to join said wire to said pipe.

Preferably, the pipe is made of a copper-nickel alloy and has an inner diameter comprised between 0.2 and 0.5 mm and a thickness comprised between 0.1 and 0.2 mm. Also preferably, the copper wire has a rectangular cross-section, the longer side of which is comprised between 0.1 and 0.3 mm and the short side of which is comprised between 0.05 and 0.2 mm. Preferably, the rectangular copper wire is wound about the pipe in such a way that its longer side is perpendicular to the pipe, while one of its shorter sides contacts the pipe.

In particular, the heat exchangers having the structure according to the invention and produced by the method of the invention are useful as heat exchangers for apparatus operating by the Joule-Thompson cycle, e.g., cryogenic and/or surgical apparatus.

DETAILED DESCRIPTION OF PREFERRED EMBODIMENTS

Figure 1:
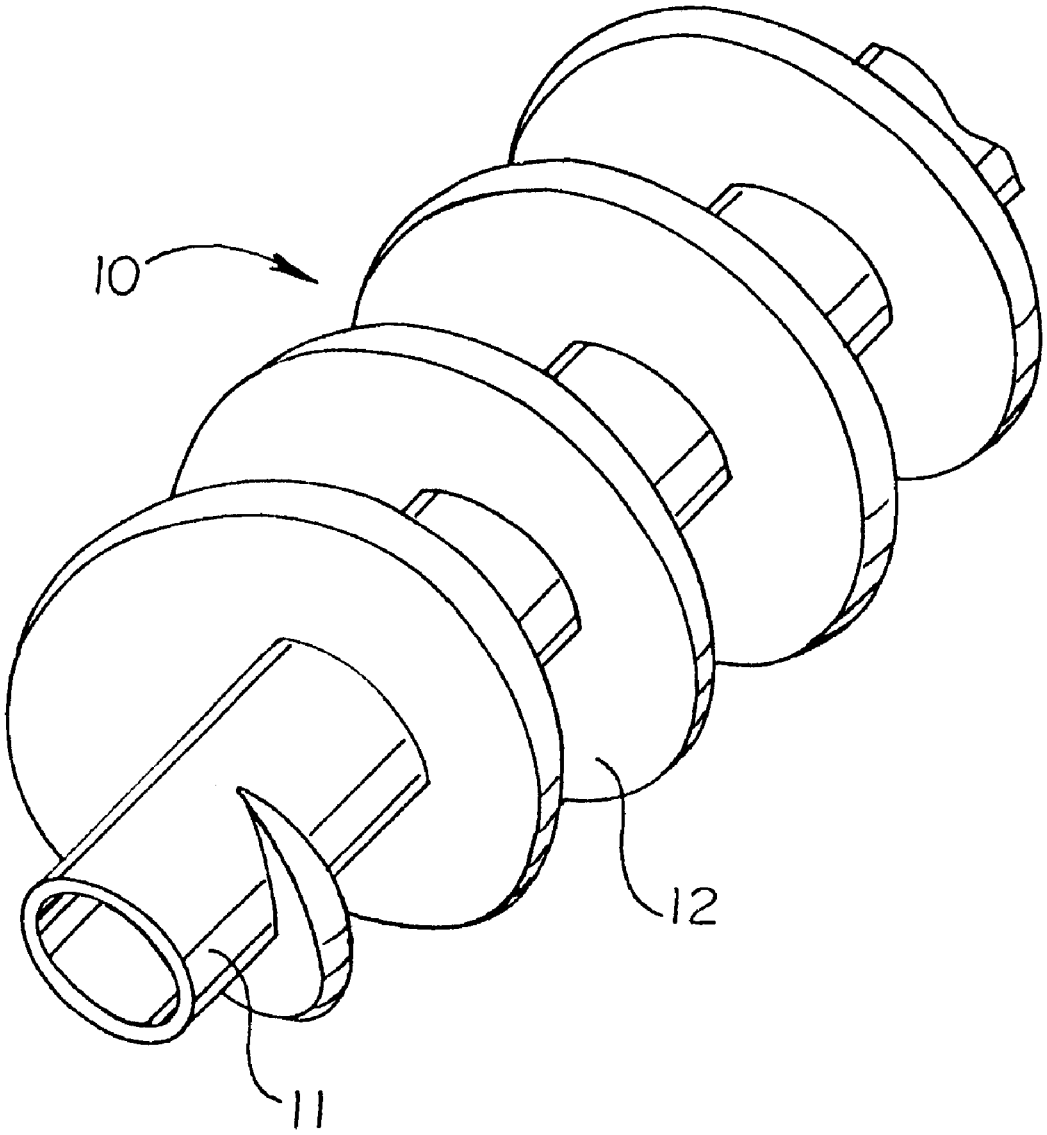
FIG. 1 is a perspective view of a portion of the assembly of a high-pressure pipe and a helical fin for a heat exchanger, according to an embodiment of the invention.

In the drawings, numeral 10 generally designates a portion of a component of a heat exchanger, according to an embodiment of the invention, and more precisely of the high-pressure duct thereof. Said duct may have any required length and its particular dimensions will be those required in each case. Only a portion thereof is shown in FIG. 1. High-pressure duct 10 comprises a pipe 11, through which fluid at high pressure flows, and a continuous helical fin 12, constituted by a rectangular wire or ribbon, generally of copper, helically wound about said pipe 11.

Figure 2:
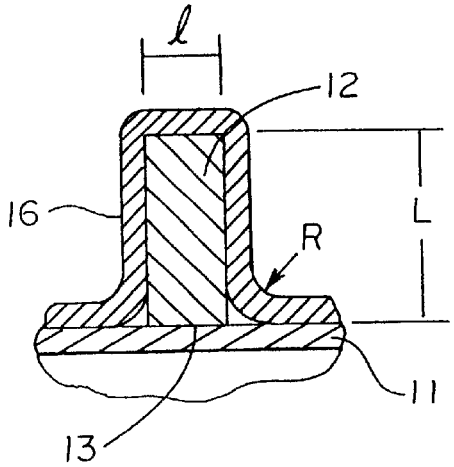
FIG. 2 is a fragmentary cross-section of the pipe-and-helical-fin assembly of FIG. 1.

FIG. 2 is a fragmentary cross-section of duct 10. It shows a cross-section of fin 12 and the portion of pipe 11 adjacent to it. As it is seen in the drawing, fin 12 has a rectangular cross-section, the longer side of the ribbon has a length L, which may vary, in general from 0.2 to 0.3 mm, and its shorter side has a length 1, which may vary between 0.05 and 0.2 mm, the longer side being perpendicular to and radially extending from pipe 11 and the shorter side contacting said pipe, as shown at 13.

The helix defined by helical fin 12 has a pitch which preferably varies between 0.8 and 1.2 mm. The tangent to said helix preferably makes an angle comprised between 10 and 30 degrees with any plane passing through the axis of pipe 11.

Figure 3:
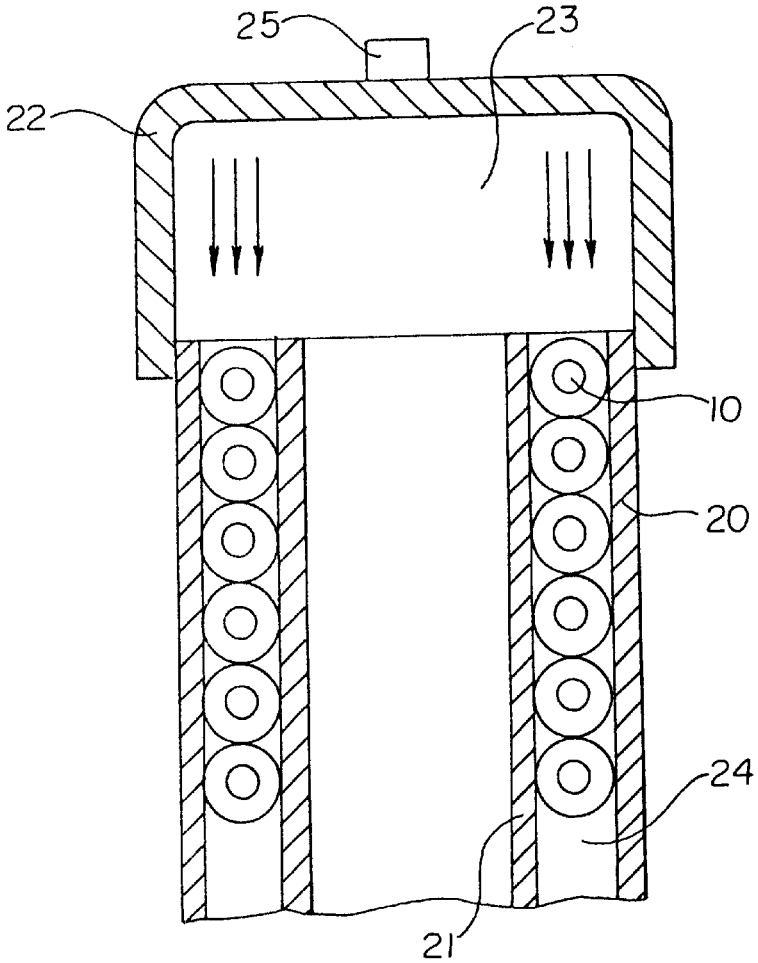
FIG. 3 is a schematic cross-section of a Joule-Thompson heat exchanger, comprising a pipe-and-helical-fin assembly according to an embodiment of the invention.

As seen in FIG. 3, a heat exchanger of the Joule-Thompson type, which is of particular, though not exclusive, interest in connection with this invention, comprises such a high-pressure duct 10 inserted into a low-pressure duct constituted by an annular space 24 defined by outer pipe 20 and inner pipe 21, a cap 22 being applied to provide a space 23 above the entrance of said annular space. The expanded gas, at low pressure, flows in the direction of the arrows through the annular space 24, and about the high-pressure duct 10, contacting pipe 11 and helical fin 12.

As best seen in FIG. 2, an electrolytic coating 16 is applied over rectangular wire 12 and pipe 11, joining the two together. The thickness of said coating, which according to the invention is pure, preferably 99% to 99.9% pure silver, varies from 3 to 8 $\mu$m, and is preferably about 5 $\mu$m.

The silver coating is created with the normal electrolytic technique, which need not be described, being well known to skilled persons.

It has been surprisingly found that the heat exchanger of this kind having a silver coating has a much better thermal behavior, in particular faster cool-down cycles, than heat exchanger of the prior art having a tin coating. This was completely unexpected, because it has always been considered that the coating has no substantial task except the mechanical one of binding the fins to the pipe to which they are applied, and it was not believed that it could have a significant influence on the heat exchange because of its extreme thinness. The superior behavior, from the transient thermal viewpoint, of a heat exchanger according to the invention is evidenced hereinafter in two ways.

Figure 4:
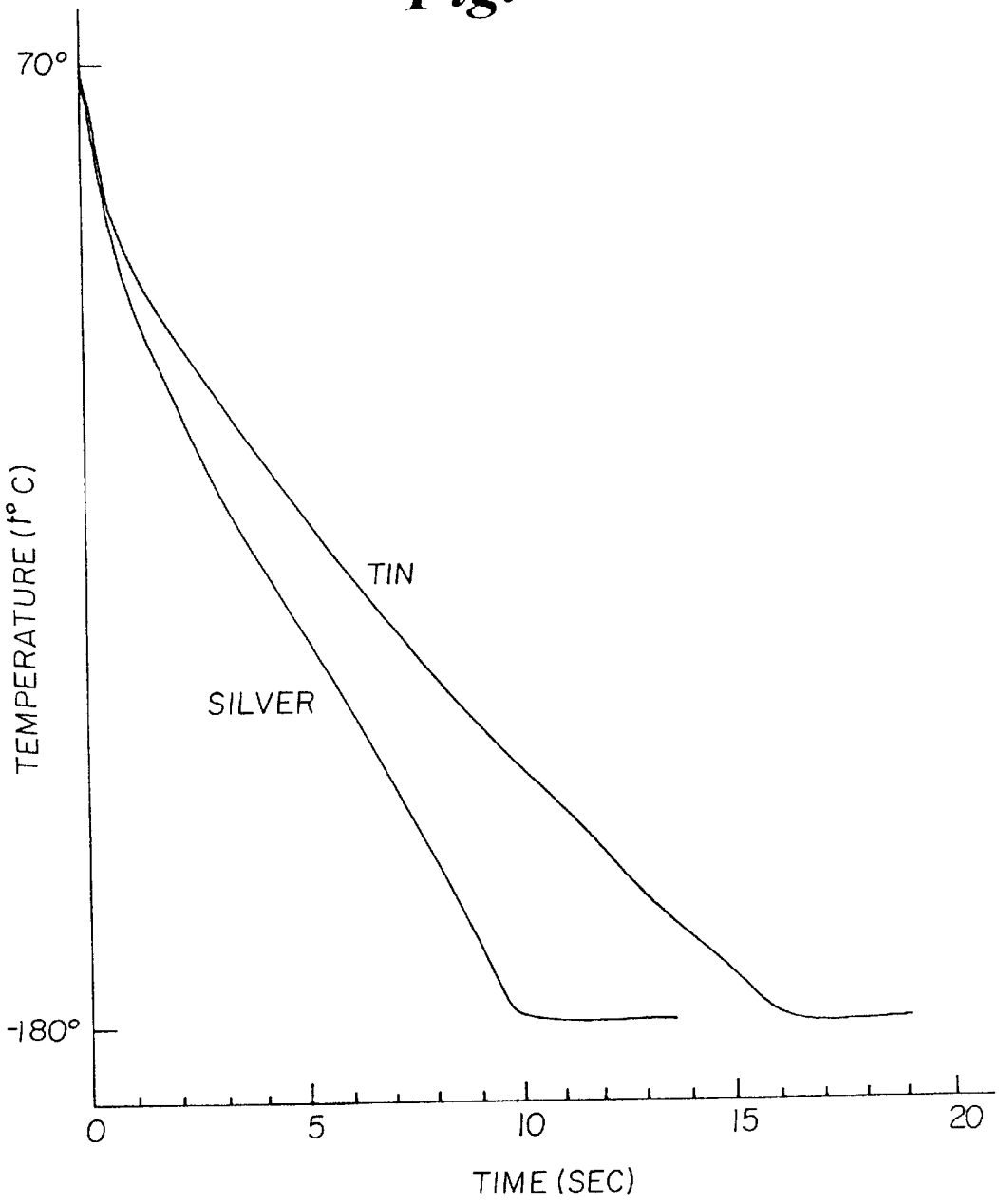
FIG. 4 shows the cool-down diagrams of two heat exchangers, one according to the prior art and the other according to the invention.

FIG. 4 refers to the behavior of a heat exchanger as illustrated in FIG. 3, having an outer diameter of 5.5 cm and comprising a high pressure pipe of copper-nickel alloy having an inner diameter of 0.35 mm and a thickness of 0.15 mm and provided with a copper ribbon of cross-section 2.5×1.5 mm. The same heat exchanger has been provided with an electrolytic tin coating and an electrolytic silver coating, both having a thickness of about 5 $\mu$m. The figure shows the cool-down curves of both heat exchangers, filled with nitrogen at 400 atmospheres from a temperature of +70° C. to a temperature of −180° C. The temperatures have been measured at the top of the exchanger cap, viz. at point 25 as seen in FIG. 3. It is seen that the exchanger with a silver coating reaches the lowermost temperature in 10 seconds, whereas the exchanger with the tin coating requires 16 seconds. Such differences are extremely relevant in fast thermal cycles of heat exchangers operating on the basis of the Joule-Thompson cycle.

The superiority of the heat exchangers according to the invention can also be exemplified by determining the times for accomplishing the liquefaction of a gas, in this case, nitrogen, contained in the high-pressure duct of such an exchanger. The exchanger was the same one to which FIG. 4 refers. When room temperature was maintained in the low-pressure duct or, at any rate, in the space in which said duct was immersed, the nitrogen was at a pressure of 400 atmospheres and the fins of the heat exchanger high-pressure duct were of copper coated with tin, the nitrogen was liquefied in 3.6 seconds. With a similar heat exchanger and all things being equal, except that the fins were coated with silver, the nitrogen was liquefied in 2.6 seconds. When the temperature in the space in which the high-pressure duct was immersed was raised to 70°, the heat exchanger having a tin coating required 15.5 seconds to produce nitrogen liquefaction, whereas the heat exchanger having a silver coating produced it in 10.5 seconds.

Additionally, the mechanical characteristics of the heat exchanger are surprisingly improved. If one attempts to separate the helical fin from the pipe by applying to them a force perpendicular to the pipe, the force required in the case of a silver coating is twice as large as that in the case of a tin coating.

Surprisingly, too, it has been found that there is a difference in the structure of the coating between a tin and a silver coating, although both are obtained by the same electrolytic process. Specifically, the silver coating has a much smaller radius of curvature at the zone adjacent the basis of the helical fun, where this latter contacts the pipe about which it is wound, than the prior art coatings. This radius of curvature is generally indicated at R in FIG. 2. This fact has been found to be very relevant in improving the heat exchange and therefore the performance of the heat exchanger and constitutes an unexpected advantage of the coating according to the invention.

It should be further noted that corrosion phenomena, connected to the difference of potential between the two metals in contact, may constitute a serious danger. One might have expected that in this respect, silver would be worse than tin. However, it has been found that there is no significant difference between the tin/copper potential and the silver/copper potential.

While some embodiments of the invention have been described by way of illustration, it will be apparent that the invention can be carried into practice by a person skilled in the art with many variations, modifications and adaptations, without departing from its spirit or exceeding the scope of the claims.

What is claimed is:

1. Heat exchanger for apparatus operating by the Joule-Thompson cycle, comprising:

a high-pressure pipe;

heat-conductive fins having opposing faces, the fins being juxtaposed to an outer surface of the pipe;

a coating of silver applied to an outer surface of the fins and to the outer surface of the pipe adjacent to opposing face of the fins, the fins being connected to the pipe by the coating of silver; and wherein the heat conductive fins have a rectangular cross-section having a length and a width, the length being greater than the width, the opposing faces extending along the width of the fins and the fin being connected to the pipe along a width of the fins.

2. Heat exchanger for apparatus operating by the Joule-Thompson cycle, comprising:

a high-pressure pipe;

heat-conductive fins having an elongate cross-section which has a length and a width, the fins being juxtaposed to the outer surface of the pipe along the fin width; and a coating of silver applied to an outer surface of the fins and to the outer surface of the pipe adjacent the fins, the fins being connected to the pipe by the coating of silver.

3. Heat exchanger, comprising:

a pipe;

substantially planar, elongate heat-conductive fins having a rectangular cross section, the cross section having a length and a width, the length being greater than the width, and opposing first and second faces along the fin length, the fin being juxtaposed to an outer surface of the pipe along the fin width; and a coating of silver applied to an outer surface of the fins and to the outer surface of the pipe adjacent to the first and second faces of the fins, the fins being connected to the pipe solely by the coating of silver.

4. Heat exchanger, comprising:

a pipe;

heat-conductive fins having an elongate cross-section, the cross-section having a length and a width, the length begin greater than the width, and opposing first and second faces along the fin length, the fin being juxtaposed to the outer surface of the pipe along the fin width; and a coating of silver applied to an outer surface of the fins and to the outer surface of the pipe adjacent to the fins, the fins being connected to the pipe solely by the coating of silver.

5. Heat exchanger according to claim 4, wherein the pipe is a high-pressure pipe.

6. Heat exchanger according to claim 4, wherein the fins comprise a metal wire helically wound about the pipe.

7. Heat exchanger according to claim 6, wherein the fins comprise a copper ribbon, having rectangular cross-section, helically wound about the pipe.

8. Heat exchanger according to claim 4, wherein the pipe is made of a copper-nickel alloy.

9. Heat exchanger according to claim 4, wherein the pipe has an inner diameter comprised between 0.2 and 0.5 mm and a thickness comprised between 0.1 and 0.2 mm.

10. Heat exchanger according to claim 7, wherein the copper ribbon has a rectangular cross-section, the longer side of which is comprised between 0.1 mm and 0.3 mm and the short side of which is comprised between 0.05 and 0.2 mm.

11. Heat exchanger according to claim 7, wherein the copper ribbon is helically wound with a helix pitch comprised between 0.8 and 1.2 mm.

12. Heat exchanger according to claim 4, wherein the silver coating has a thickness comprised between 3 and 8 $\mu$m.

13. Heat exchanger according to claim 4, wherein the silver coating covers the outer surface of the pipe adjacent the fins and extends away from the fins on the outer surface of the pipe.

14. Heat exchanger according to claim 4, wherein the silver coating covers the outer surface of each of the fins from the outer surface of the pipe on a first side continuously to the outer surface of the pipe on a second side.

15. Heat exchanger according to claim 4, wherein the outer surface of the pipe comprises a continuous uninterrupted are proximate the fin.

16. Heat exchanger according to claim 15, wherein the fins and the pipe comprise separate elements and wherein the fins directly abut the outer surface of the pipe.

17. The heat exchanger of claim 4, wherein the coating of silver is applied to the outer surface of the fins and to the outer surface of the pipe adjacent the opposing first and second faces of the fin.

18. The heat exchanger of claim 4, wherein the elongate cross section is rectangular.

* * * * *